US010190586B2

(12) United States Patent
Chikano et al.

(10) Patent No.: US 10,190,586 B2
(45) Date of Patent: Jan. 29, 2019

(54) SCROLL COMPRESSOR AND AIR CONDITIONER

(71) Applicant: Hitachi-Johnson Controls Air Conditioning, Inc., Minato-ku, Tokyo (JP)

(72) Inventors: Masatsugu Chikano, Mito (JP); Yuichi Yanagase, Namegata (JP); Masashi Miyake, Shizuoka (JP); Masaru Ohtahara, Shizuoka (JP); Hiromu Takeda, Shizuoka (JP)

(73) Assignee: Hitachi-Johnson Controls Air Conditioning, Inc., Tokyo (JP)

( * ) Notice: Subject to any disclaimer, the term of this patent is extended or adjusted under 35 U.S.C. 154(b) by 934 days.

(21) Appl. No.: 13/770,420

(22) Filed: Feb. 19, 2013

(65) Prior Publication Data

US 2013/0219950 A1 Aug. 29, 2013

(30) Foreign Application Priority Data

Feb. 29, 2012 (JP) ..... 2012-042696

(51) Int. Cl.
*F03C 2/00* (2006.01)
*F03C 4/00* (2006.01)
(Continued)

(52) U.S. Cl.
CPC ..... *F04C 18/0246* (2013.01); *F04C 18/0207* (2013.01); *F04C 18/0215* (2013.01);
(Continued)

(58) Field of Classification Search
CPC ..... F04C 18/0215; F04C 18/0253; F04C 18/0269; F04C 18/02; F04C 18/0207; F04C 29/00; F04C 18/30
(Continued)

(56) References Cited

U.S. PATENT DOCUMENTS 4,304,535 A * 12/1981 Terauchi ..... 418/55.2
4,477,239 A * 10/1984 Yoshii et al. ..... 418/55.2
5,344,294 A * 9/1994 Itoh et al. ..... 418/55.2

FOREIGN PATENT DOCUMENTS

JP 08-232863 * 9/1996 ..... F04C 18/02
JP 8-232863 A 9/1996
JP 2005-180298 A 7/2005

OTHER PUBLICATIONS

Unverified English translation of B1 (JP 2005-180298 A) previously filed on Feb. 19, 2013 (Nine (9) pages).

* cited by examiner

*Primary Examiner* — Theresa Trieu
(74) *Attorney, Agent, or Firm* — Crowell & Moring LLP

(57) ABSTRACT

A compressor is provided with a fixed scroll having a spiral lap erected on a bed plate; an orbiting scroll having a spiral lap erected on a panel and forming a compression room meshed with the fixed scroll; and an orbiting bearing disposed penetrating the panel and the central part of the lap of the orbiting scroll, wherein a lap center is so shifted from a panel center out of alignment in a direction in which, within a range in which the orbiting bearing can be formed in the central part of the lap, the longer of the minimum distance between the lap winding end position of the orbiting scroll and the outer circumference of the panel and the minimum distance between the outermost circumferential part and the outer circumference of the panel in an approximately 90° direction of becomes the shortest distance.

17 Claims, 9 Drawing Sheets

(51) Int. Cl.
*F04C 2/00* (2006.01)
*F04C 18/02* (2006.01)
*F04C 23/00* (2006.01)

(52) U.S. Cl.
CPC ..... *F04C 18/0269* (2013.01); *F04C 18/0253* (2013.01); *F04C 23/008* (2013.01)

(58) Field of Classification Search
USPC ..... 418/55.2, 55.3, 55.5
See application file for complete search history.

Prior Art

Prior Art

SCROLL COMPRESSOR AND AIR CONDITIONER

FIELD OF THE INVENTION

The present invention relates to a scroll compressor to be used suitably as a refrigerant compressor in a refrigerating cycle for refrigeration or air conditioning purposes or as a gas compressor for compressing air or the like.

BACKGROUND OF THE INVENTION

Background art in this technological field include Japanese Unexamined Patent Application Publication No. 2005-180298 (Patent document 1). This publication refers to "a scroll compressor in which the volute center of the orbiting scroll volute body and the volute center of the fixed scroll volute body are disposed in positions shifted, relative to the centers of the end plates of the orbiting scroll and the fixed scroll, in the direction of a straight line linking the winding end positions of the two volute bodies to the volute center of the Archimedean spiral curve or the envelope thereof" (see Claim 1 of the publication).

Another case of relevant background art is found in Japanese Unexamined Patent Application Publication No. Hei8-232863 (Patent document 2), which contains a mention of "a shaft penetrating scroll compressor in which an orbiting bearing part is disposed in the central part of an orbiting scroll member and an eccentric shaft part of a crankshaft is inserted into the orbiting bearing part to the lap tip part" (see Claim 1 of the publication).

SUMMARY OF THE INVENTION

No particular consideration has been given to such offsetting of laps as restraining an increase in the outer diameter of a scroll compressor of a shaft penetrating structure having a bearing part in the central part of the laps of an orbiting scroll.

In order to address the problem, configurations stated in the claims for the present invention, for instance, are adopted.

The invention includes a plurality of devices to solve the problem noted below, and one example is stated below:

A scroll compressor comprising a fixed scroll having a spiral lap erected on a bed plate; an orbiting scroll having a spiral lap erected on a panel and forming a compression room meshed with the fixed scroll; and an orbiting bearing disposed penetrating the panel and the central part of the lap of the orbiting scroll, wherein the orbiting scroll is formed in such a manner as to so shift a lap center from a panel center out of alignment, when the panel center and the lap center are in the same state, as to bring the minimum distance between a winding end position of the lap of the orbiting scroll and the outer circumference of the panel close to the minimum distance between the outer circumferential part which, out of the outer circumferential parts of the lap in a direction of 45° to 135° with the center of the panel from the lap winding end position of the orbiting scroll as its center, has the longer of the minimum distances to the outer circumference of the panel.

The scroll compressor of a shaft penetrating structure can serve to restrain an increase in the outer diameter of the compressor while securing a necessary designed volume ratio and to make efficiency enhancement and diametric reduction compatible.

DETAILED DESCRIPTION OF THE PREFERRED EMBODIMENT

Preferred embodiments of the present invention will be described below with reference to the accompanying drawings.

Embodiments

Figure 2:
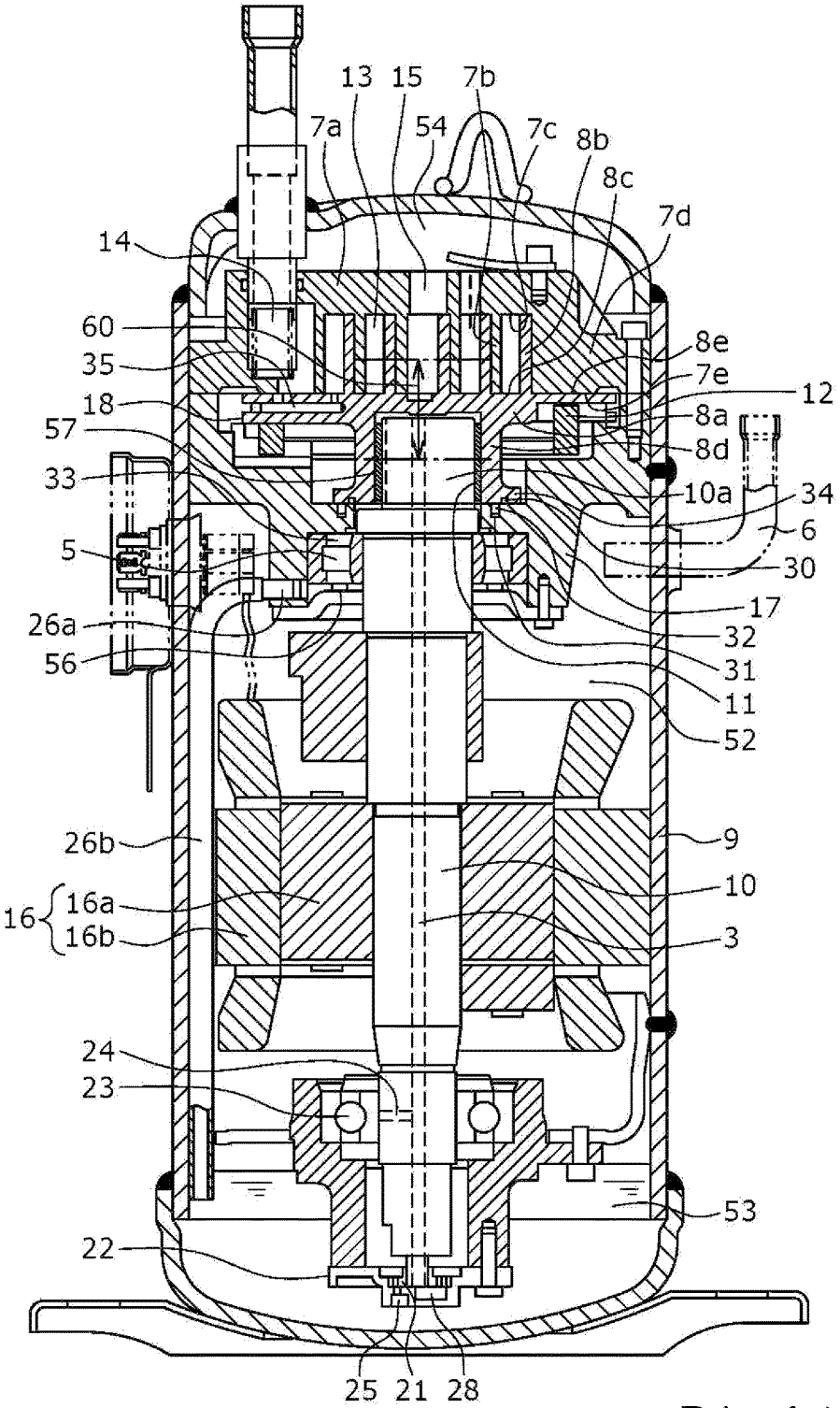
FIG. 2 shows an exemplar vertical section of a scroll compressor.

First, the basic structure of a scroll compressor will be described. FIG. 2 is an exemplar vertical section of a scroll compressor of a conventional structure. As illustrated therein, a fixed scroll (fixed scroll member) 7 has a disk-shaped bed plate 7*a*, a lap 7*b* spirally erected on this bed plate 7*a*, and a cylindrical supporting part 7*d* positioned on the outer circumferential side of the bed plate 7*a* and having a panel continuous to the tip face of the lap 7*b* to surround the lap 7*b*.

The surface of the bed plate 7*a* on which the lap 7*b* is erected is called a tooth bottom 7*c* because it is located between segments of the lap 7*b*. The face of the supporting part 7*d* in contact with a panel 8*a* of an orbiting scroll (orbiting scroll member) 8 is a panel face 7*e* of a fixed scroll 7. The supporting part 7*d* of the fixed scroll 7 is fixed to a frame 17 with bolts or the like, and the frame 17 integrated with the fixed scroll 7 is fixed to a case (sealed vessel) 9 by welding or otherwise.

The orbiting scroll 8 is arranged opposing the fixed scroll 7, and disposed to be able to orbit in the frame 17 as the lap 7*b* of the fixed scroll and a lap 8*b* of the orbiting scroll are meshed with each other. The orbiting scroll 8 has a disk-shaped panel 8*a*, the spiral lap 8*b* erected on a tooth bottom 8*c*, which is a surface of this panel 8*a*, and a boss part 8*d* disposed at the center of the rear face of the panel 8*a*. The outer circumferential face of the panel 8*a* in contact with the fixed scroll 7 constitutes a panel face 8*e* of the orbiting scroll 8.

The case 9 has a sealed vessel structure housing a scroll part comprising the fixed scroll 7 and the orbiting scroll 8, a motor part 16 (16*a*: rotor, 16*b*: stator), lubricating oil, and so forth. A shaft (rotation shaft) 10 fixed integrally with the rotor 16*a* of the motor part 16 is rotatably supported by the frame 17 via a main bearing 5 and is coaxial with the central axis of the fixed scroll 7.

A crank 10*a* is provided at the tip of the shaft 10. This crank 10*a* is inserted into an orbiting bearing 11 disposed on the boss part 8*d* of the orbiting scroll 8, which is configured to be able to rotate along with the rotation of the shaft 10. The central axis of the orbiting scroll 8 is in a state of being eccentric relative to the central axis of the fixed scroll 7 by a prescribed distance. Further, the lap 8*b* of the orbiting scroll 8 is superposed over the lap 8*b* of the fixed scroll 7 with a shift by a prescribed angle. Reference numeral 12 denotes an Oldham ring for orbiting the orbiting scroll 8 relative to the fixed scroll 7 while so restraining it as not to rotate on its own axis.

Figure 3:
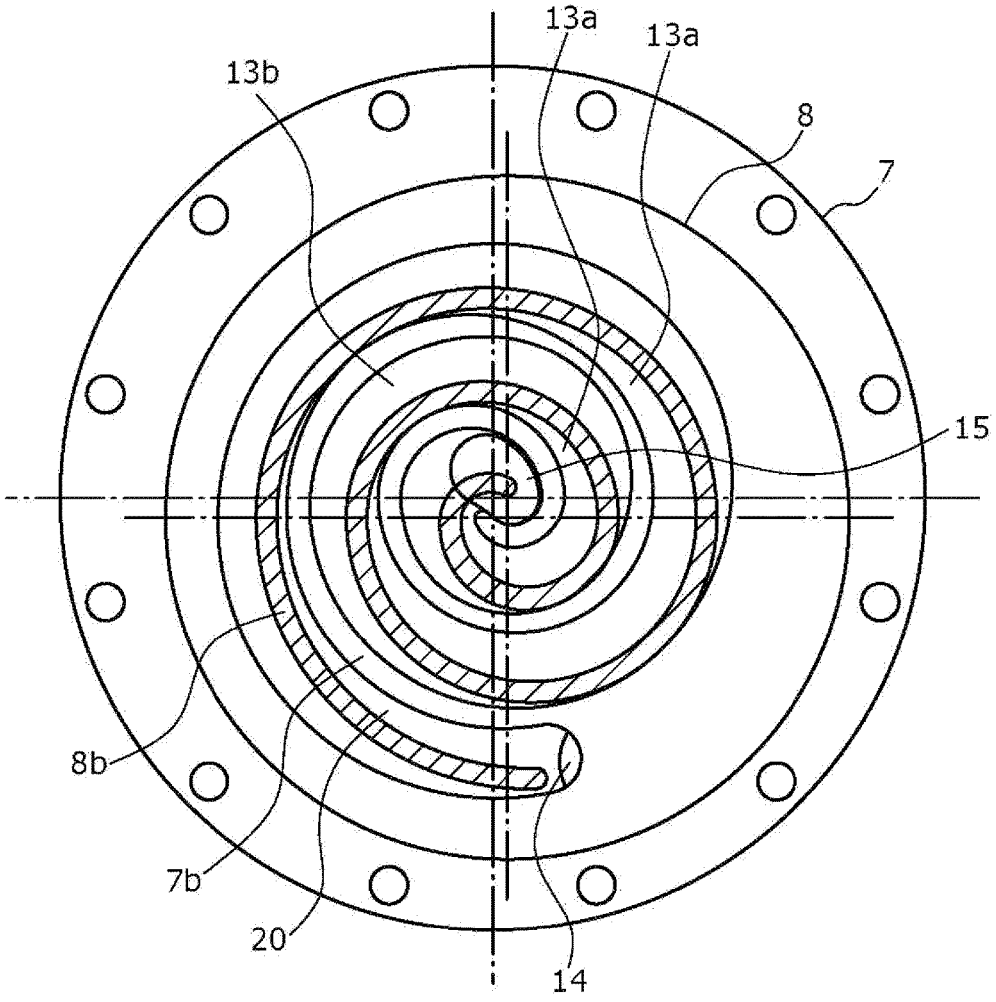
FIG. 3 is a plan of a state of meshing between a fixed scroll and an orbiting scroll.

FIG. 3 is a plan of a state of meshing between a fixed scroll and an orbiting scroll in the conventional structure. As illustrated, a plurality of crescent-shaped compression rooms 13 (13*a* and 13*b*) are formed between the laps 7*b* and 8*b*. When the orbiting scroll 8 is caused to orbit, each of the compression rooms is compressed in volume as it shifts toward the central part. Thus, the orbiting internal line side compression room 13*a* and the orbiting external line side compression room 13*b* are formed on the internal line side and the external line side, respectively, of the lap 8*b* of the orbiting scroll 8. Reference numeral 20 denotes a suction room, a space on the way of sucking fluid. This suction room 20 becomes the compression rooms 13 from the point of time when the phase of the orbiting motion of the orbiting scroll advances to complete sealing-in of the fluid. Incidentally, regarding both the lap 8*b* of the orbiting scroll and the lap 7*b* of the fixed scroll, the central side of the lap is referred to as the lap winding start part and the outer circumferential part of the lap, as the lap winding end part.

A suction port 14, as shown in FIG. 2 and FIG. 3, is disposed in the fixed scroll 7. This suction port 14 is so bored in the outer circumferential side of the bed plate 7*a* as to communicate with the suction room 20. Further, a discharge port 15 is so bored in the vicinity of the volute center of the bed plate 7*a* of the fixed scroll 7 as to communicate with the compression room 13 on the innermost circumferential side.

When the shaft 10 is rotationally driven by the motor part 16, the rotational motion is transmitted from the crank 10*a* of the shaft 10 to the orbiting scroll 8 via the orbiting bearing 11, and the orbiting scroll 8 orbits around the central axis of the fixed scroll 7 with an orbiting radius of a prescribed length. During this orbiting motion, the orbiting scroll 8 is so restrained by the Oldham ring 12 as not to rotate on its own axis.

By the orbiting motion of the orbiting scroll 8, each of the compression rooms 13 formed between the laps 7*b* and 8*b* is continuously shifted toward the center and, along with that shifting, the volumes of the compression rooms 13 are continuously contracted. This causes the fluid (e.g. refrigerant gas circulating in a refrigerating cycle) sucked through the suction port 14 to be successively compressed in the compression rooms 13, and the compressed fluid is discharged through the discharge port 15 into a discharge space 54 in the upper part of the case. The discharged fluid enters a motor room 52 in the case 9 from the discharge space 54, and supplies through a discharge pipe 6 to outside the compressor, for instance into a refrigerating cycle.

Lubricating oil is deposited at the bottom of the case 9, and a displacement type or centrifugal type oil feed pump 21 is provided at the lower end of the shaft 10. Along with the rotation of the shaft, the oil feed pump 21 is also rotated, and the lubricating oil is sucked through a lubricating oil suction inlet 25 provided in an oil feed pump case 22 and discharged through a discharge outlet 28 of the oil feed pump. The discharged lubricating oil is supplied to a higher part by way of a through hole 3 bored in the shaft. Part of the lubricating oil lubricates a sub-bearing 23 via a transverse hole 24 bored in the shaft 10, and returns to an oil sump 53 in the bottom part of the case. The remaining majority part of the lubricating oil reaches the upper part of the crank 10*a* of the shaft 10 via the through hole 3, and lubricates the orbiting bearing 11 via an oil groove 57 cut in the crank 10*a*. After lubricating the main bearing 5 disposed underneath the orbiting bearing 11, this majority part of the lubricating oil returns to the bottom part of the case via a waste oil hole 26*a* and a waste oil pipe 26*b*. Hereinafter, a space formed by the oil groove 57 and the orbiting bearing 11 and another space accommodating the main bearing 5 (a space formed by the frame 17, the shaft 10, a frame seal 56, a flange-shaped orbiting boss member 34 disposed on the boss part 8*d* of the orbiting scroll 8, and a seal member 32) will be collectively referred to as a first space 33. This first space 33 has a pressure close to the discharge pressure. A majority part of the lubricating oil having flowed into the first space 33 to lubricate the main bearing 5 and the orbiting bearing 11 returns to the bottom part of the case via the waste oil hole 26*a* and the waste oil pipe 26, but some of the lubricating oil in a minimum quantity required for lubrication of the Oldham ring 12 and for lubricating and sealing the sliding parts of the fixed scroll 7 and the orbiting scroll 8 enters a back pressure room 18, which is a second space, via an oil leaking device between the upper end face of the seal member 32 and an end face of the orbiting boss member 34.

The seal member 32 is inserted into an annular groove 31 cut in the frame 17 together with a wavy spring (not shown), and partitions the first space 33 under the discharge pressure from the back pressure room 18 under an intermediate pressure between the suction pressure and the discharge pressure. The oil leaking device is configured of, for instance, a plurality of holes 30 bored into the orbiting boss member 34 and the seal member 32, and the plurality of holes 30 shifts between the first space 33 and the back pressure room 18 in circular motions across the seal member 32 along with the orbiting motion of the orbiting scroll 8. By depositing the lubricating oil in the first space 33 into the holes 30 in this way and intermittently shifting and discharging the oil into the back pressure room 18, the minimum required quantity of oil can be guided to the back pressure room 18. In place of the plurality of holes 30, slits or the like may as well be provided for the oil leaking device to serve the back pressure room.

The lubricating oil having entered the back pressure room 18 enters, when the back pressure has risen, into the compression rooms 13 through a back pressure hole 35 that establishes communication between the back pressure room 18 and the compression rooms 13 and is discharged through the discharge port 15. Some of the oil is discharged through the discharge pipe 6 into a refrigerating cycle together with, for instance, refrigerant gas, and the remainder is separated from the refrigerant gas in the case 9 and deposited in the oil sump 53 at the bottom of the case.

To add, since the quantities of oil supplied to bearings and those of oil supplied to the compression rooms are enabled to be controlled independent of each other by providing the first space 33, the back pressure room 18, and the oil leaking device as described above, it is made possible to ensure oil supply to the compression rooms in appropriate quantities, resulting in a highly efficient compressor.

Next, the back pressure will be described in detail. In the scroll compressor, its compressive actions give rise to a force working to pull apart the fixed scroll 7 and the orbiting scroll 8 from each other. When this force in the axial direction invites separation of the scrolls, a so-called separating phenomenon of the orbiting scroll 8, the sealed state of the compression rooms is loosened, resulting in a drop in the efficiency of the compressor. In view of this problem, on the rear side of the panel of the orbiting scroll 8, the back pressure room 18 having a pressure level between the discharge pressure and the suction pressure is arranged, and its back pressure is used to cancel the separating force as well as to press the orbiting scroll 8 against the fixed scroll 7. If the pressing force in this process is too great, the sliding friction loss between the panel face 8*e* of the orbiting scroll 8 and the panel face 7*e* of the fixed scroll 7 will increase and the compressor efficiency will drop. Thus, there is an optimum level of the back pressure, under which the sealed state of the compression rooms is loosened to invite an increase in thermo-hydrodynamic loss and above which the sliding friction loss will increase. Therefore, keeping the back pressure at its optimum level is of vital importance to enhancing the performance and reliability of the compressor.

In order to obtain this optimum back pressure level, the scroll compressor shown in FIG. 2 is provided with the back pressure hole 35, which is a U-shaped passage for establishing communication between the compression rooms 13 and the back pressure room 18 to introduce a pressure matching the pressures in the compression rooms into the back pressure room 18. The pressures in the compression rooms 13 rise with the rotation of a crankshaft. The location of the section in which communication from the compression rooms 13 in the compression process to the back pressure room 18 is established determines the level of the back pressure. Therefore, it is possible to set the back pressure level to its optimum by adjusting this section of establishing communication.

The basic structure of the scroll compressor has been described so far. Disadvantages of this structure include a large upsetting moment of the orbiting scroll. The upsetting moment will be described below. The orbiting scroll by its own compressive action is subject not only to the axial direction mentioned above but also to a force in the horizontal direction. Its point of action is the center of the lap 8*b* of the orbiting scroll in the perpendicular direction. The point where the orbiting scroll is restrained is the approximate center of the orbiting bearing 11 in the perpendicular direction. Thus, the point where the load works on and the point where the orbiting scroll is restrained is apart by the distance denoted by 60 in FIG. 2. For this reason the moment arises, and its magnitude increases with the length of the distance 60. This moment is referred to as the upsetting moment of the orbiting scroll. If the upsetting moment is great, gaps will occur between the laps and panels of the orbiting scroll 8 and the fixed scroll 7 to increase the leak loss. Moreover, the back pressure will have to be raised to increase the force of pressing the orbiting scroll 8 against the fixed scroll 7, which would mean increased sliding friction loss between the two panels.

Figure 4:
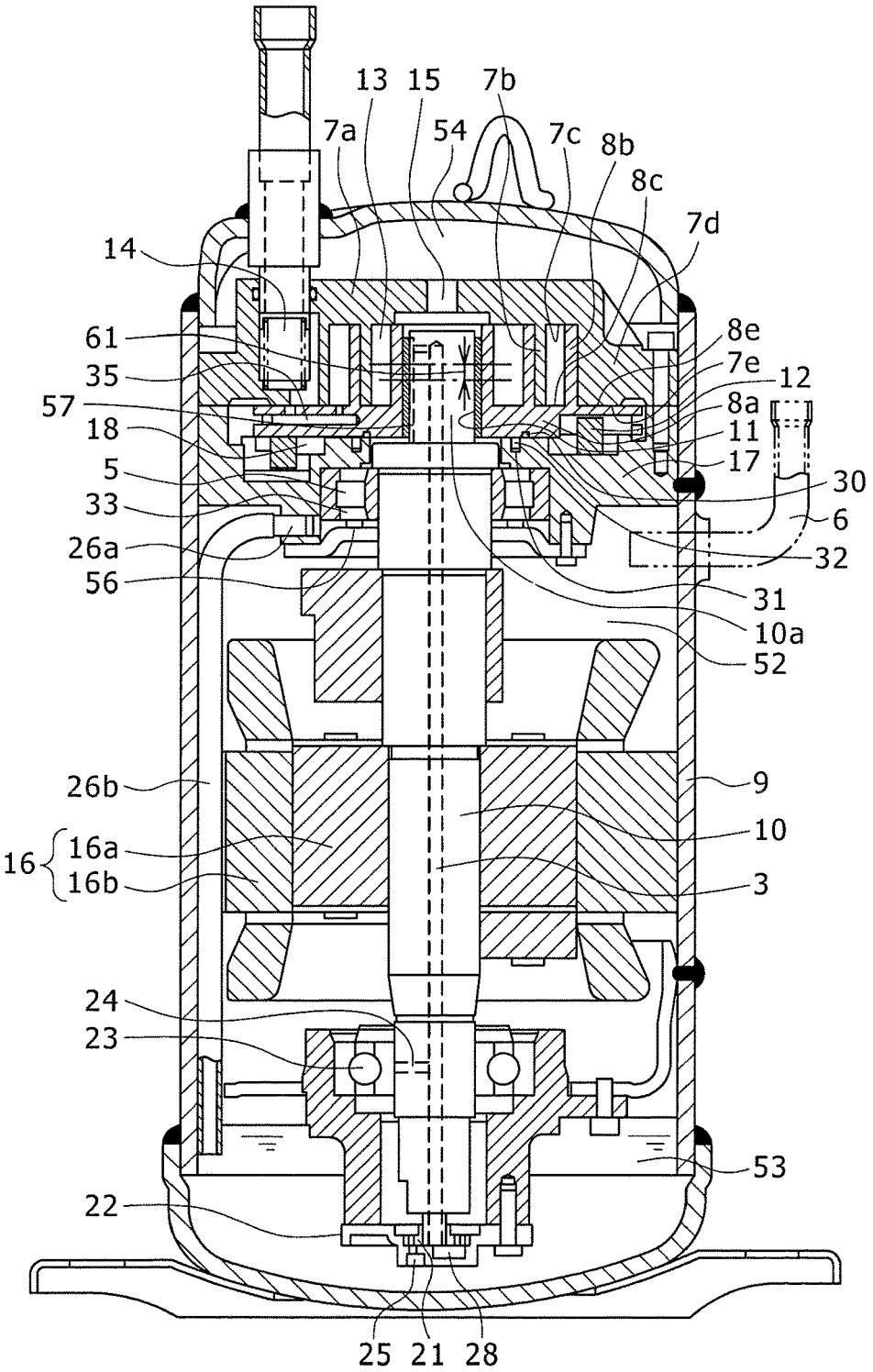
FIG. 4 shows an exemplar vertical section of the scroll compressor of a shaft penetrating structure.

As a structure to reduce this upsetting moment, a shaft penetrating structure for scroll compressors is known. This structure has an orbiting bearing 11 penetrating the central parts of the panel 8*a* and the lap 8*b* of the orbiting scroll 8 as shown in FIG. 4. In this structure, the distance between the working point of the load and the point of restraining the orbiting scroll is denoted by 61 in FIG. 4, which is substantially shorter than the distance 60 in FIG. 2. Namely, the upsetting moment can be substantially reduced and a high efficiency compressor subject to reduced leak loss and sliding friction loss can be obtained.

Figure 1:
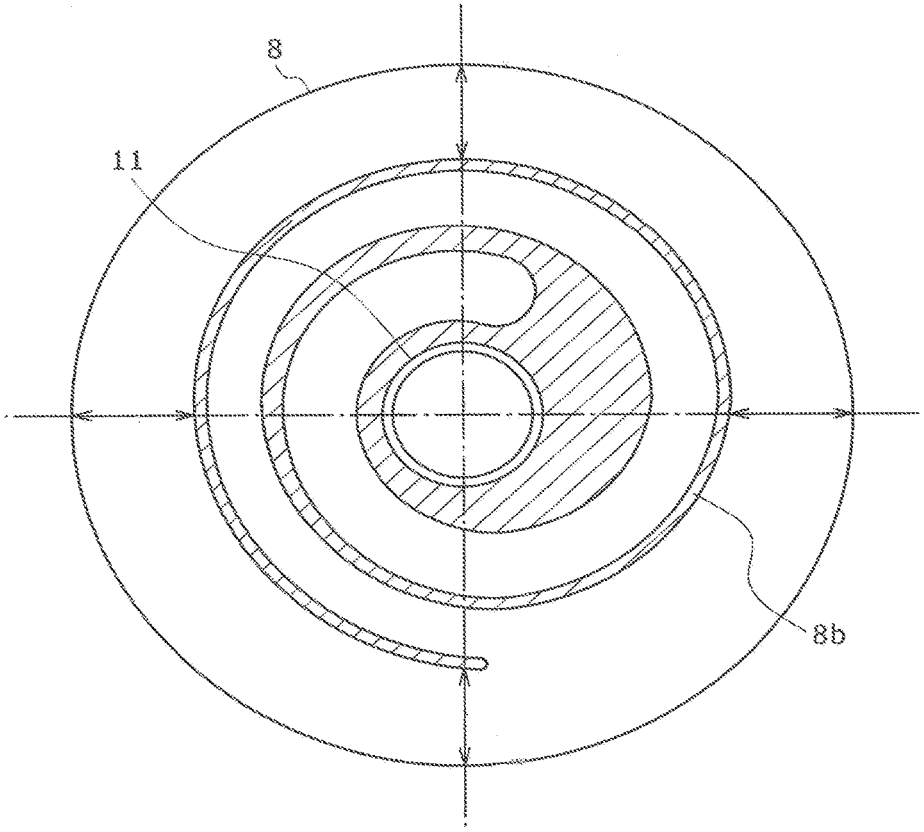
FIG. 1 shows a plan of an orbiting scroll using an Archimedean spiral curve, which is one embodiment of the present invention.

As described above, a scroll compressor of such a shaft penetrating structure, though it excels in efficiency, has its own disadvantage of a greater outer circumference of the compressor. FIG. 1 shows a plan of an orbiting scroll of a shaft penetrating structure. As illustrated, the orbiting bearing 11 has to be arranged in the central part of the lap. Therefore, in order to secure a prescribed designed volume ratio, the number of turns of the lap increases, resulting in a larger orbiting scroll and consequently a greater outer circumference of the compressor.

In view of this problem, the present invention proposes a structure in which the lap center and the panel center of the orbiting scroll are shifted out of alignment, and the outer circumference of the panel is reduced without allowing leaks from the panel to increase and a structure that keeps the outer circumference of the panel unchanged and further reduces leak loss from the panel.

Figure 5:
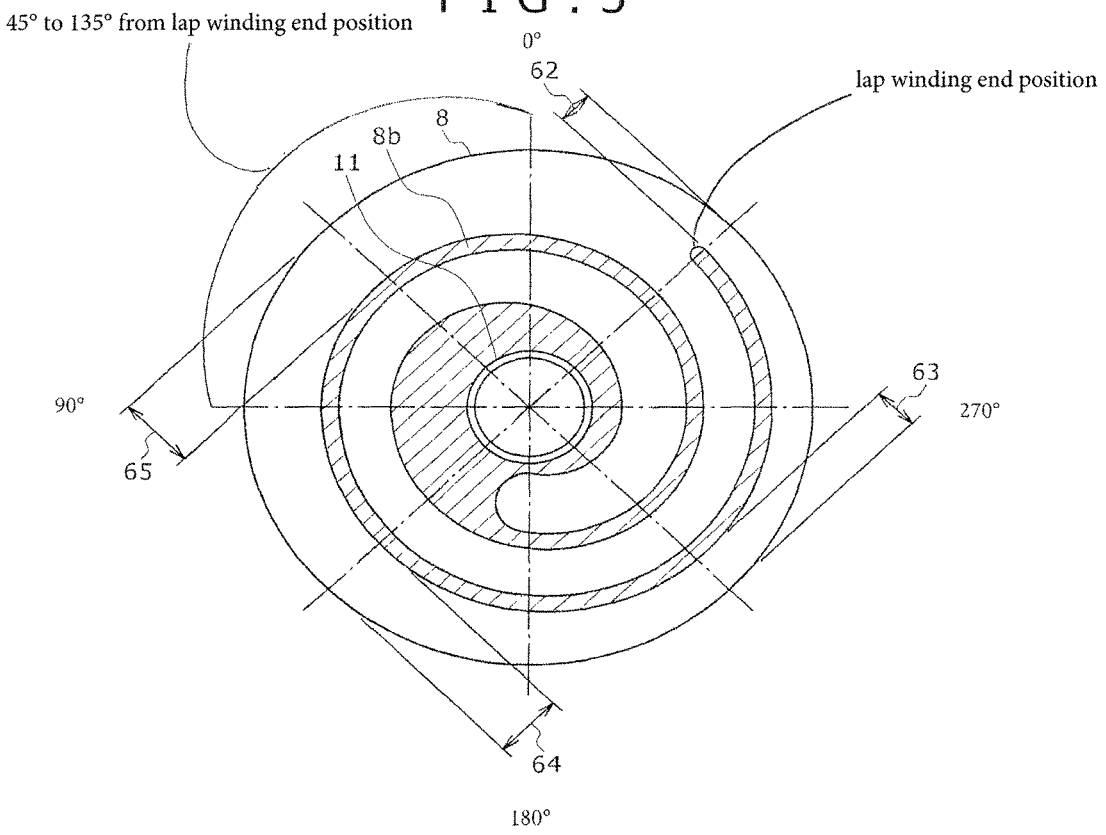
FIG. 5 shows a plan of an orbiting scroll of a conventional structure using an involute curve.

First, details of the structure hat keeps the outer circumference of the panel unchanged and further reduces leak loss from the panel will be described. FIG. 5 shows a plan of the orbiting scroll 8 before the lap center and the panel center are shifted out of alignment, namely in a state in which the two centers are in the same position. Reference numerals 62, 63, 64 and 65 denote the seal lengths on the panel. The seal length means the length of a leak channel having a minute gap. The panel face 8*e* of the orbiting scroll 8 and the panel face 7*e* of the fixed scroll 7 oppose each other with a minute gap in-between. The pressure is equal to the back pressure on the outer circumference of the panel and equal to the suction pressure or an interim pressure in the process of compression toward the inner circumference from the lap center and, owing to the differential pressure between the back pressure and the suction pressure or the interim pressure in the process of compression, a leak flow is present in the minute gap. As the quantity of this leak decreases with an increase in seal length, it is necessary to secure a certain seal length in order to reduce leak loss from the panel.

To compare the four seal lengths in FIG. 5, the seal length 65 is the greatest, followed by the seal lengths 64, 63 and 62 in this order; in other words, the lengths are not uniform. The seal length 62 is the minimum distance between the winding end position of the lap and the outer circumference of the panel, and this seal length 62 is the shortest among the seal lengths to the panel. Therefore, considering leaks from different parts of the panel, the leak from this seal length 62 region is dominant.

As shown in FIG. 5, a distance between a winding end position of the lap of the orbiting scroll and an outer circumference of the panel is a maximum, within a region along a winding direction located between 45° to 135° in a counterclockwise direction (e.g., 225° to 315° in a clockwise direction) from the lap winding end position of the orbiting scroll with respect to the panel center.

Figure 7:
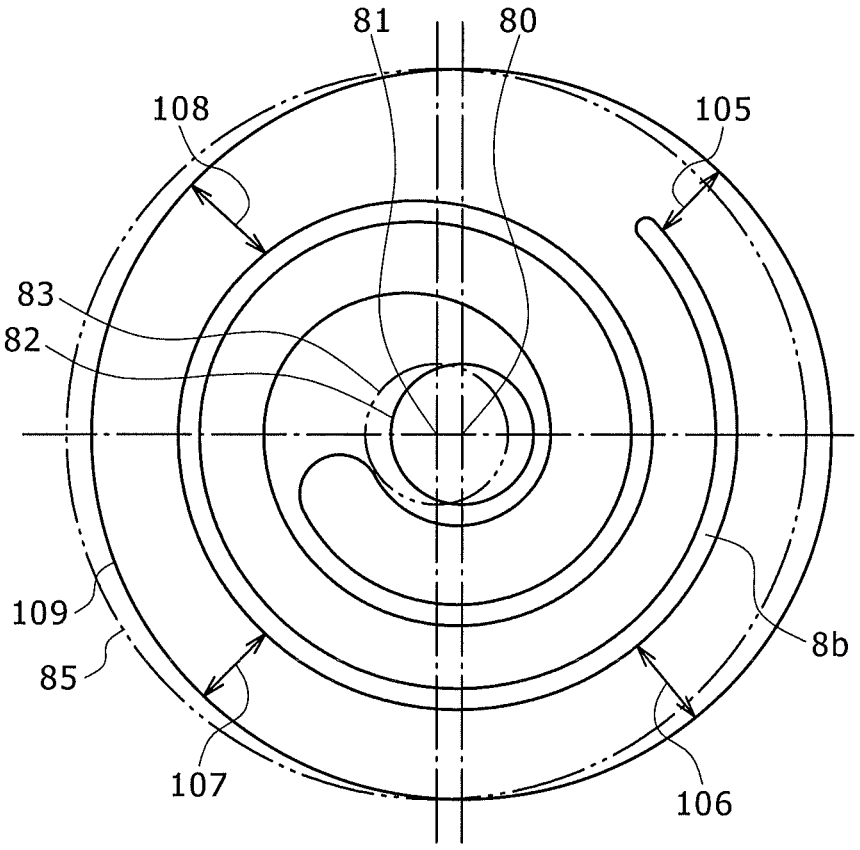
FIG. 7 shows a plan of another offset of the laps in the earlier cited embodiment of the invention.

To substantially uniformize these four seal lengths, the lap center and the panel center are shifted out of alignment according to the invention. The direction of this shifting will be described with reference to FIG. 5 and FIG. 7. As the seal length 62 is shorter than the seal length 64 in FIG. 5, first the panel center is shifted up rightward relative to the lap center. Then, as the seal length 63 is shorter than the seal length 65, the panel center is shifted down rightward. Thus, by shifting (offsetting) the panel center substantially rightward relative to the lap center, the four seal lengths 105, 106, 107 and 108 can be substantially uniformized as shown in FIG. 7. A point 81 in FIG. 7 denotes the lap center and a point 80, the panel center. In other words, the orbiting scroll 8 is formed by so shifting the lap center 81 from the panel center 80 out of alignment that, when the panel center 80 and the lap center 81 are in the same state (FIG. 5), as to bring the minimum distance (62 in FIG. 5) between the winding end position of the lap 8*b* of the orbiting scroll 8 and the outer circumference of the panel 8*a* close to the minimum distance (65 in FIG. 5) between the outer circumferential part which, out of the outer circumferential parts of the lap in the direction of approximately 90° with the center of the panel 8*a* from the lap winding end position of the orbiting scroll 8 as its center, has the longer of the minimum distances to the outer circumference of the panel.

Whereas the seal lengths 105, 106, 107 and 108 can be substantially uniformized by using such a configuration (FIG. 7), the formation process may as well be such that the lap center is so shifted from the panel center out of alignment as to bring the minimum distance of the outer circumferential part of the lap having the longer of the minimum distances, out of the outer circumferential parts of the lap in the direction of 45° to 135° from the lap winding end position of the orbiting scroll 8 with the panel center as its center, to the minimum distance of the outer circumference of the pertinent panel.

To add, as described earlier, FIG. 7 shows a case in which the outer diameter of the panel 85 before offset is made the same as the outer diameter of the panel 109 after offset. Although the outer diameter of the panel cannot be made smaller in this case, leak loss from the panel can be reduced to realize a high efficiency compressor because the seal length 62 in FIG. 5, which dominates leaks from the panel, can be extended up to the seal length 105. To add, obviously, the configuration is such that the lap center of the fixed scroll 7 is also offset as much as the lap center and the panel center of the orbiting scroll 8 are offset so that compression rooms can be formed by meshing the two scrolls.

Figure 6:
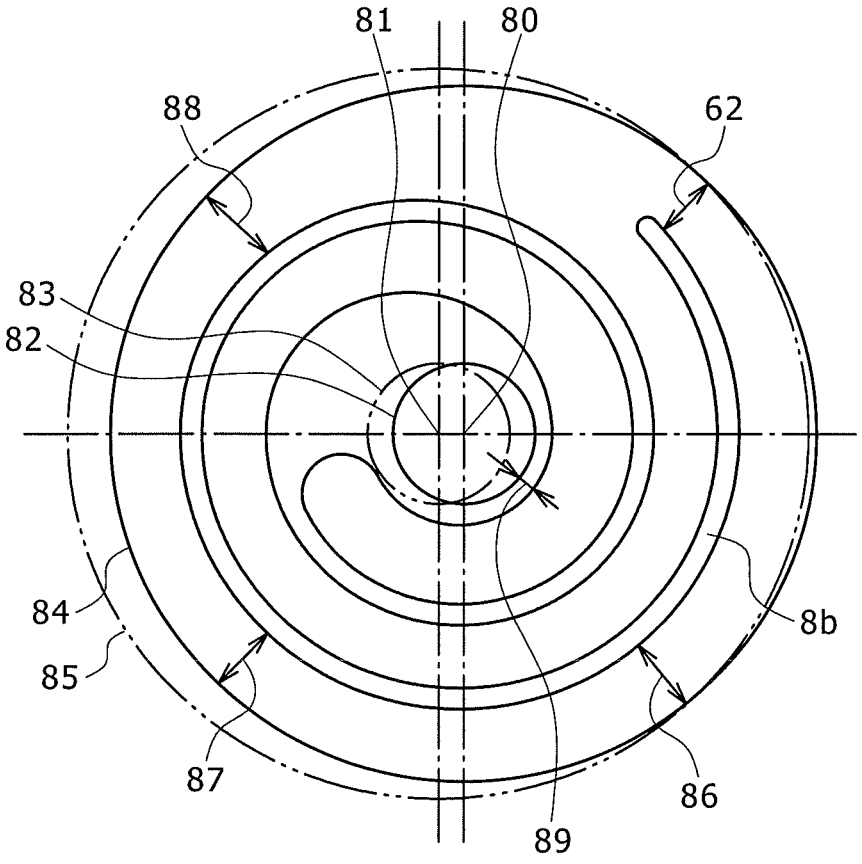
FIG. 6 shows a plan of an offset of laps in another embodiment of the invention.

As another embodiment, FIG. 6 shows a case in which, the seal length 62 being the same, the outer diameter of the panel 84 after offset is made smaller than that of the panel 85 before offset. As the upsetting moment can be reduced in a compressor of the shaft penetrating structure, the leak quantity from the seal length 62 region, which dominates leaks from the panel, can be regarded as minute. Thus, there is no need to elongate the seal length 62 any more. In this case, the offset between the panel center and the lap center can serve to reduce the outer diameter of the panel.

Figure 8:
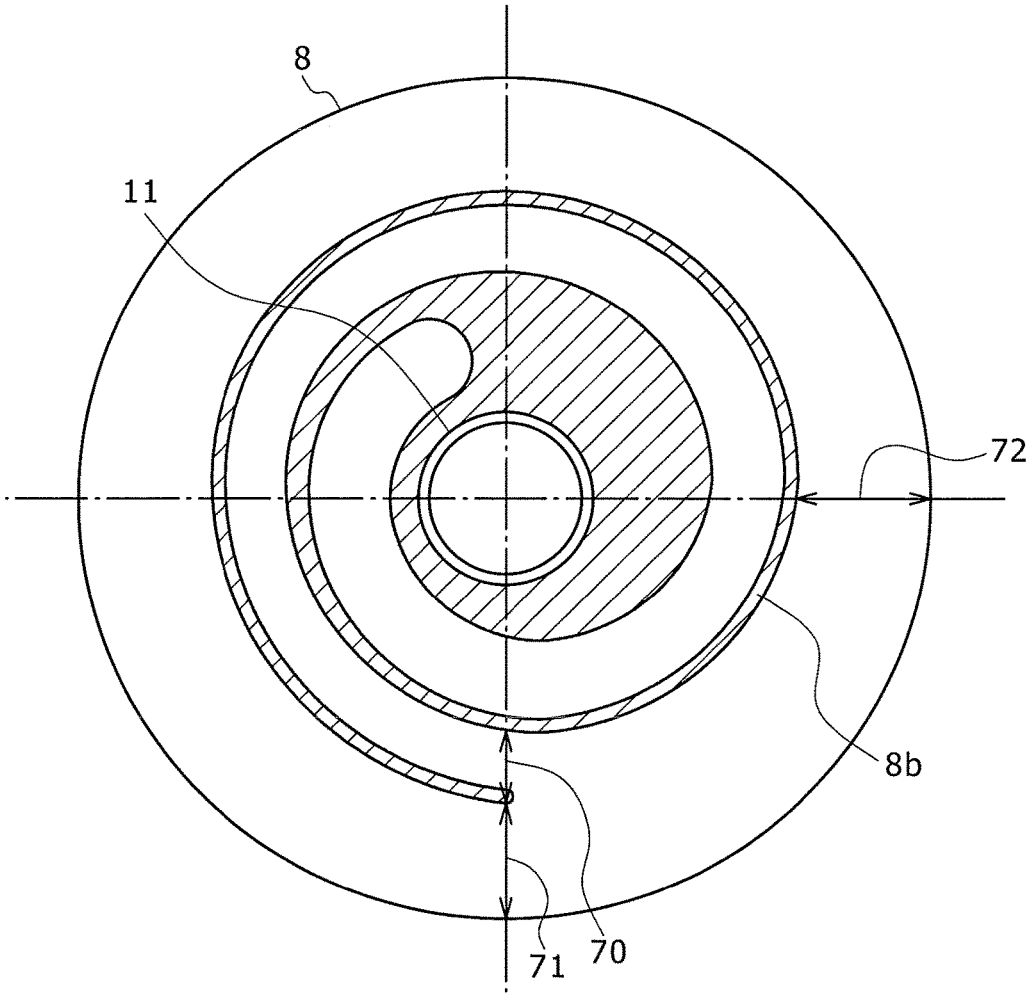
FIG. 8 shows a plan of an orbiting scroll of a conventional structure using an Archimedean spiral curve.

Incidentally, the case illustrated in this diagram uses an involute curve as the lap curve, it is even more advisable to use either or both of an Archimedean spiral curve and its envelope as the lap curve. The Archimedean spiral curve, by virtue of its geometrical characteristics, can give a greater designed volume ratio than an involute curve when the distance between the lap center and the lap winding end position is the same. In other words, when the designed volume ratio is the same, the outer diameter can be reduced. Furthermore, the Archimedean spiral curve gives a smaller lap thickness and a shorter distance between laps as the lap winding end position is approached. The combined length of the lap thickness and the distance between laps is denoted by 70 in FIG. 8. As the length 70 is short, the seal length 71 in FIG. 8 is made longer, and the difference between the seal lengths 72 and 71 becomes shorter than the difference between the seal lengths 65 and 62 according to the involute curve shown in FIG. 5. Thus, the distance over which the lap center and the panel center are offset can be reduced, resulting in greater freedom of design.

Further, when the lap center and the panel center are to be offset, it is better also to shift the center of the orbiting bearing 11 together with the panel center. Reference numeral 83 in FIG. 6 denotes the orbiting bearing 11 before offset, and 82, the orbiting bearing 11 after offset. The center of 82 is made coincident with the panel center 80. As this serves to position the center of gravity of the orbiting scroll 8 close to the center of the orbiting bearing 11, occurrence of any extra moment on the orbiting scroll can be restrained, the outer diameter of the compressor can also be reduced.

It is to be noted, however, that formation of the orbiting bearing 11 requires a certain thickness of its central part of to hold the orbiting bearing 11 on its outer circumferential part. Thus, the thickness denoted by 89 in FIG. 6 should be secured to a certain extent. Whereas the center of the orbiting bearing 11 can be shifted only within a range in which this thickness can be secured. In other words, the lap thickness, orbiting radius, and the position of the lap winding start part can be so adjusted as to enable the thickness 89 to be secured.

Figure 9:
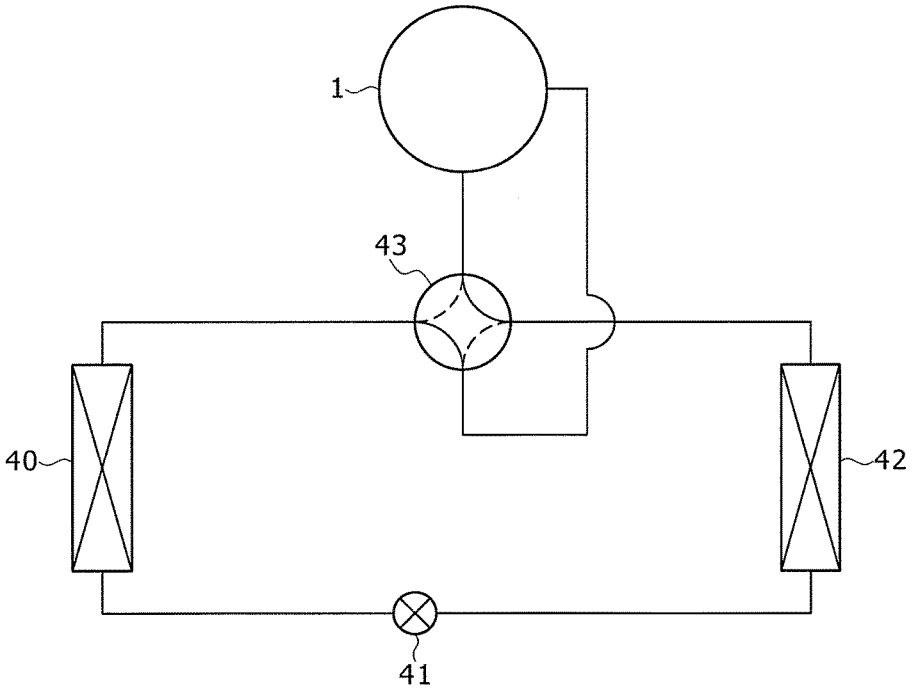
FIG. 9 is a conceptual diagram of a refrigerating cycle in the embodiment of the invention.

By configuring a refrigerating cycle for air conditioning purposes as shown in FIG. 9 by using the compressor 1, a condenser 40, an expansion valve 41, an evaporator 42, and a four-way valve 43, it is made possible to provide an air conditioner reduced in annual power consumption, having a broad operational range and easy to use.

What is claimed is:

1. A scroll compressor comprising:

a fixed scroll having a lap with a spiral shape erected on a bed plate;

an orbiting scroll having a lap with a spiral shape erected on a panel and forming a compression room meshed with the fixed scroll; and an orbiting bearing disposed penetrating the panel and a central part of the lap of the orbiting scroll, wherein:

the orbiting scroll is formed in such a manner so as to shift a lap center from a panel center out of alignment, when the panel center and the lap center are in the same state, to thereby bring a distance between a winding end position of the lap of the orbiting scroll and an outer circumference of the panel to a maximum, within a region along a winding direction located between 45° to 135° in a counterclockwise direction from the lap winding end position of the orbiting scroll with respect to the panel center.

2. The scroll compressor as claimed in claim 1, wherein:

the lap center is shifted so as to bring a minimum distance between the winding end position of the lap of the orbiting scroll and the outer circumference of the panel close to a minimum distance between one outer circumferential part out of outer circumferential parts of the lap in which a winding direction of 90° with the center of the panel from the lap winding end position of the orbiting scroll as its center, has a longest minimum distance to the outer circumference of the panel.

3. The scroll compressor as claimed in claim 1, wherein:

the fixed scroll has a lap center of the fixed scroll is so shifted from a center of the bed plate out of alignment as to take on the same relationship as that between the lap center of the orbiting scroll and the panel center.

4. The scroll compressor as claimed in claim 1, wherein:

a spiral curve of the lap of the orbiting scroll and the fixed scroll is formed of an involute curve.

5. The scroll compressor as claimed in claim 1, wherein:

a spiral curve of the lap of the orbiting scroll and the fixed scroll is formed of an Archimedean spiral curve.

6. The scroll compressor as claimed in claim 1, wherein:

an outer diameter of the panel after the lap center has been shifted from the panel center out of alignment, when the panel center and the lap center are in the same state, is the same as the outer diameter of the panel before the shifting.

7. The scroll compressor as claimed in claim 1, wherein:

an outer diameter of the panel after the lap center has been shifted from the panel center out of alignment is made smaller than the outer diameter of the panel before the shifting so that a minimum distance between the orbiting scroll and the outer circumference of the panel does not change.

8. The scroll compressor as claimed in claim 1, wherein:

the panel center of the orbiting scroll and a center of the orbiting bearing are made substantially coincident.

9. An air conditioner comprising:

a compressor;

a condenser;

an expansion valve; and an evaporator, wherein the compressor includes a fixed scroll having a lap with a spiral shape erected on a bed plate, an orbiting scroll having a lap with a spiral shape erected on a panel and forming a compression room meshed with the fixed scroll, and an orbiting bearing disposed penetrating the panel and a central part of the lap of the orbiting scroll, wherein the orbiting scroll is formed in such a manner so as to shift a lap center from a panel center out of alignment, when the panel center and the lap center are in the same state, to thereby bring a distance between a winding end position of the lap of the orbiting scroll and an outer circumference of the panel to a maximum, within a region along a winding direction located between 45° to 135° in a counterclockwise direction from the lap winding end position of the orbiting scroll with respect to the panel center.

10. The air conditioner according to claim 9, wherein:

the lap center is shifted so as to bring a minimum distance between the winding end position of the lap of the orbiting scroll and the outer circumference of the panel close to a minimum distance between the one outer circumferential part out of outer circumferential parts of the lap in which a winding direction of 90° with the center of the panel from the lap winding end position of the orbiting scroll as its center, has a longest minimum distance to the outer circumference of the panel.

11. The air conditioner according to claim 9, wherein:

the fixed scroll has a lap center of the fixed scroll is so shifted from a bed plate center out of alignment as to take on the same relationship as that between a lap center of the orbiting scroll and the panel center.

12. The air conditioner according to claim 9, wherein:

a spiral curve of the lap of the orbiting scroll and the fixed scroll is formed of an involute curve.

13. The air conditioner according to claim 9, wherein:

a spiral curve of the lap of the orbiting scroll and the fixed scroll is formed of an Archimedean spiral curve.

14. The air conditioner according to claim 9, wherein:

an outer diameter of the panel after the lap center has been shifted from the panel center out of alignment, when the panel center and the lap center are in the same state, is the same as the outer diameter of the panel before the shifting.

15. The air conditioner according to claim 9, wherein:

an outer diameter of the panel after the lap center has been shifted from the panel center out of alignment is made smaller than the outer diameter of the panel before the shifting so that a minimum distance between the orbiting scroll and the outer circumference of the panel does not change.

16. The air conditioner according to claim 9, wherein:

the panel center of the orbiting scroll and a center of the orbiting bearing are made substantially coincident.

17. A scroll compressor comprising:

a fixed scroll having a spiral lap erected on a bed plate;

an orbiting scroll having a spiral lap erected on a panel and forming a compression room meshed with the fixed scroll; and an orbiting bearing disposed penetrating the panel and a central part of the lap of the orbiting scroll, wherein:

the orbiting scroll is formed in such a manner as to so shift a lap center from a panel center out of alignment, when the panel center and the lap center are in the same state, so that distances between an outer circumference of the panel and a surface on the spiral lap that directly faces the outer circumference of the panel, measured at intervals beginning at a lap winding end position and at 90°, 180°, and 270° from the lap winding end position with respect to the panel center, approach uniformity.

* * * * *